US006318851B1

(12) United States Patent
Hoen et al.

(10) Patent No.: US 6,318,851 B1
(45) Date of Patent: Nov. 20, 2001

(54) METHOD AND SYSTEM FOR PURGING AIR FROM A PRINT MECHANISM

(75) Inventors: Storrs T. Hoen, Brisbane; Jonah A. Harley, Palo Alto, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/287,506

(22) Filed: Apr. 7, 1999

(51) Int. Cl.[7] ..... B41J 2/19
(52) U.S. Cl. ..... 347/92
(58) Field of Search ..... 347/85, 86, 87, 347/92, 93, 6, 14, 19

(56) References Cited

U.S. PATENT DOCUMENTS

| | | | |
|---|---|---|---|
| 5,650,811 | 7/1997 | Seccombe et al. | 347/85 |
| 5,852,459 | 12/1998 | Pawlowski, Jr. et al. | 347/86 |
| 5,870,126 | 2/1999 | Kondo et al. | 347/92 |
| 5,872,584 | 2/1999 | Hauck et al. | 347/86 |
| 5,874,977 | 2/1999 | Ishinaga et al. | 347/86 |
| 5,877,795 | 3/1999 | Gragg et al. | 347/92 |
| 5,880,748 | 3/1999 | Childers et al. | 347/6 |

*Primary Examiner*—N. Le
*Assistant Examiner*—Michael P. Nghiem
(74) *Attorney, Agent, or Firm*—Marc P. Schuyler

(57) ABSTRACT

A printer pen has a pressure regulation system and a mechanism for purging air from the pen using the pressure regulation system. More specifically, a pressure sensor and a permanent magnet actuator open and close an internal valve to selectively pressurize a local ink container with ink to achieve a precise pen back pressure, which may be specific for each pen in order to maximize print quality. The pen also has a blow-off vent and internal conduits which channel trapped air upward, toward the vent. When too much air is detected within the ink container (based on transient response as sensed by the pressure sensor), the pen is moved near an external tab at or near a service station, such that the tab physically opens the blow-off vent. The internal valve is also opened to permit the pen to pressurize (ink is normally at below-atmospheric pressure) and thereby expel air through the blow-off vent. Once sufficient air is released, the pen is moved to close the blow-off vent and, with the internal valve closed, the print head is fired a controlled amount to achieve optimal back pressure.

9 Claims, 6 Drawing Sheets

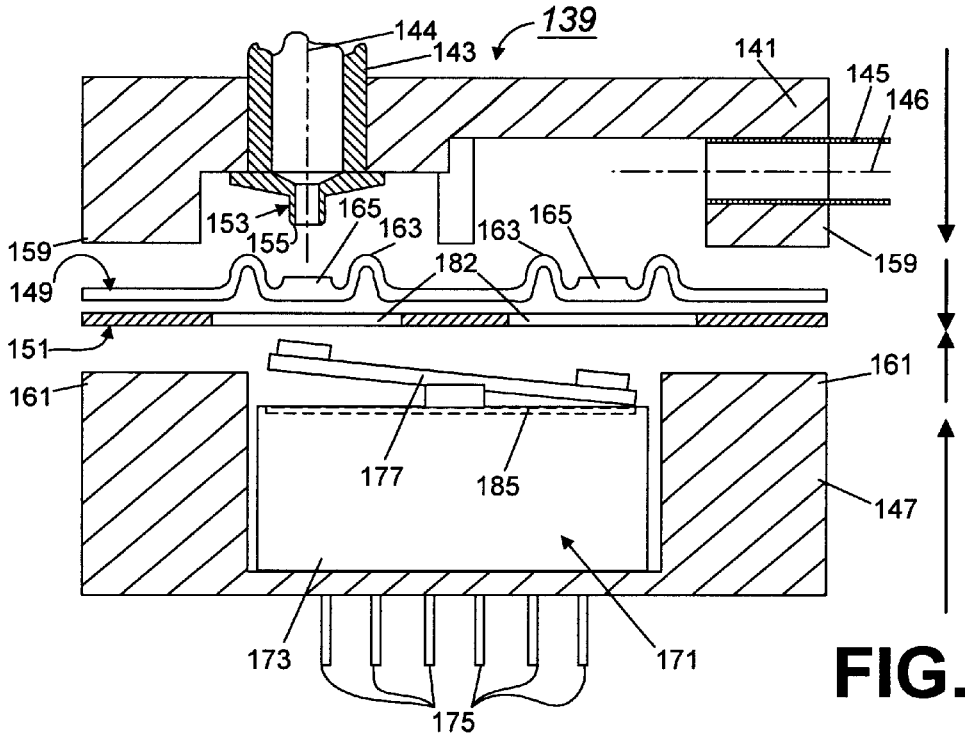
FIG. 4
FIG. 5
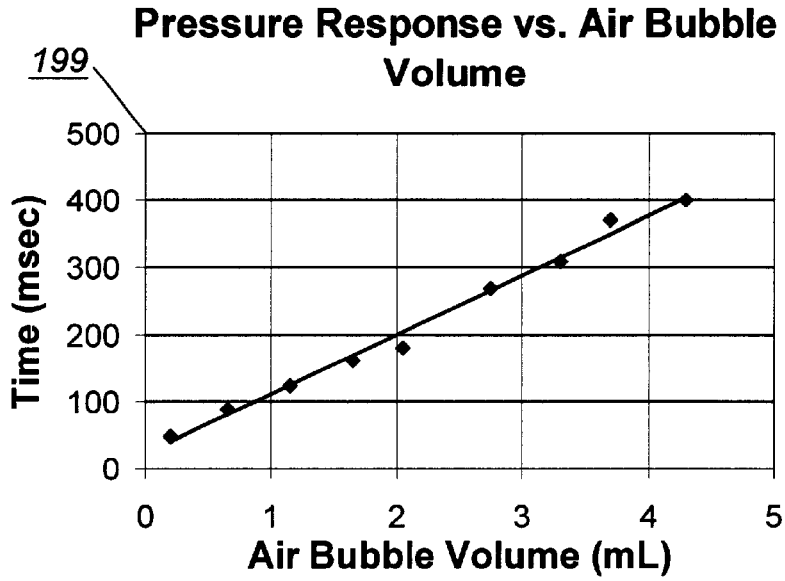

METHOD AND SYSTEM FOR PURGING AIR FROM A PRINT MECHANISM

The present invention relates to printers. More particularly, this disclosure provides a system for purging air from a print mechanism.

BACKGROUND

Ink jet printers offer a mechanism for producing high print quality using inexpensive print materials. Typically, a print head includes a silicon substrate having hundreds of tiny jets per inch, each ejecting droplets of ink under the control of a microprocessor. This print head is usually mounted within a movable pen, which travels on a carriage directly over a paper conveyance path. In black-and-white printing, a single ink supply and print head is used, whereas two to four ink supplies and associated pens are normally used in color printing. Conventionally, in home printers, the ink supply is contained directly in each pen, and the pen usually must be completely replaced when the ink is gone. In larger ink jet printers used in some businesses, the ink supply is usually removed from the pen (so-called off-axis printing) due to the large ink supply required.

In both home and commercial applications, the cost of printing can be significantly affected by the need to occasionally replace the ink cartridge and its attached print head. This cost is somewhat lessened with off-axis printing since a relatively larger ink supply may be used (requiring less frequent ink replenishment) and may be more easily replaced using a removable, remote reservoir. Also, with the reservoir detached from the print head, the print head does not need to be replaced each time the ink reservoir is replaced.

One logistical problem in off-axis printing, however, is that it becomes more difficult to regulate the pressure of the ink supplied to the print head, sometimes called the pen "back pressure." Importantly, the ink near the print head is usually held slightly less than atmospheric pressure, to avoid any tendency of the ink to drool from ink jet spray nozzles. At the same time, a minimum ink pressure usually must be maintained in order to reliably print.

Air trapped inside the local ink compartment of a pen can present a significant problem in controlling back pressure. Air can become trapped due to a variety of causes: For example, air dissolved in ink can be reduced over time or through temperature changes; air can be introduced by shipping or priming procedures, or when an ink supply is replaced; air can enter the ink supply through the print head, or via diffusion through tubing or other pen components. Since air is much more compressible than ink and expands with temperature or altitude, a small change in the quantity of air present in an ink supply can dramatically affect print quality. Air bubbles can also potentially clog the tiny jets of a print head, thereby directly affecting print quality and print head life.

Some methods have been proposed for cleaning print heads or for purging air bubbles from print heads. These methods, while generally successful for their intended purposes, generally do not provide an effective mechanism for removing large quantities of air trapped inside an ink supply. Similarly, while some air could be deliberately used as a compliant element inside ink pens, the proposed methods of purging air, however, are also generally not sufficiently precise to control air quantities for this purpose.

A need exists for a system that can purge trapped air in a print mechanism. Further still, a need exists for a system which can purge air directly from a local ink reservoir, such that pen back pressure can be more precisely controlled. Ideally, such a system should permit precise control over air within a print mechanism, such that some air can be left in the print mechanism if desired for some pen designs. The present invention solves these needs and provides further, related advantages.

SUMMARY

The present invention solves the aforementioned needs by providing a system for purging air from an print mechanism. By using the pressure regulation system and a blow-off vent to purge unwanted air, the present invention facilitates relatively precise control of back pressure, even permitting optimization of back pressure on an individual-print mechanism basis. As should be apparent, the present invention thereby potentially enables each print mechanism to be operated at roughly optimal back pressure, with ideally optimal print quality as a result.

One form of the invention provides a method of purging air from a print ink container. This method uses a sensor system to sense amount of air within the container, a blow-off vent and an electrically-controlled ink pressurizing mechanism used to pressurize the container with ink. The blow-off vent is positioned within the container such that air gravitates upward through the ink toward the normally-closed vent. The sensor system is used to indicate the amount of air within the container, and if too much air is present, the blow-off vent is opened and the container is simultaneously pressurized with ink, such that the unwanted air is expelled through the blow-off vent. In more detailed aspects of this form of the invention, the sensor can be a pressure sensor and the pressurizing mechanism can include both an electrically-controlled valve and a relatively pressurized remote ink supply.

Second and third forms of the invention provide an improvement in printing and an apparatus that roughly correspond to the first form of the invention.

The invention may be better understood by referring to the following detailed description, which should be read in conjunction with the accompanying drawings. The detailed description of a particular preferred embodiment, set out below to enable one to build and use one particular implementation of the invention, is not intended to limit the enumerated claims, but to serve as a particular example thereof.

BRIEF DESCRIPTION OF THE DRAWINGS

FIG. 1 is an illustrative diagram which shows an off-axis ink supply used for a printer or plotter. In particular, FIG. 1 shows a remote reservoir, a pen body, and a supply line which carries ink from the remote reservoir to the pen body.

FIG. 2 is a schematic diagram of a pressure regulator used in the pen body seen in FIG. 1; in particular, FIG. 2 shows use of an electrically-controlled valve as part of a feedback loop that helps maintain ink at relatively precise pressure within the pen body seen in FIG. 1.

FIG. 3 is a perspective diagram showing the layout of components within the pen body of FIG. 1, including an internal valve, a blow-off vent, and a pressure sensor.

FIG. 4 is a cross-sectional diagram of a preferred valve used in the pressure regulation system of FIG. 2.

FIG. 5 is a graph illustrating amount of air internal to a pen's ink container as a function of pressure response sensed via the pressure sensor of FIG. 3.

As seen in FIG. 6, as the pens are moved to the printer's extreme right, a tab lifts all four leaf springs. FIG. 6 also illustrates four remote ink supplies, and hoses which supply ink to the corresponding pens.

FIG. 8 shows movement of a pen to bring a remote tab into contact with a leaf spring at the top of the pen; FIG. 8 also shows two air pockets inside the pen which are to be reduced. Importantly, while FIG. 6 shows lateral movement of the pen to bring the tab and leaf spring together, forward pen movement as illustrated in FIG. 8 may also be used (e.g., an embodiment which may be preferred when the pen is to be serviced by a rotating service station).

FIG. 9 shows interaction of the tab and leaf spring to open a blow-off vent. Importantly, an interior valve of the pen is also electronically opened at this time, permitting the pen to pressurize with ink (to at least atmospheric pressure), thereby expelling air through the blow-off vent and reducing the size of the air pockets.

FIG. 10 is similar to FIG. 9, but shows the interior valve in a closed state.

FIG. 11 shows removal of the pen such that the leaf spring is withdrawn out of contact with the tab, causing the blow-off vent to close; firing the print head with the pen in this condition may be used to reduce the pressure inside the pen to below atmospheric, such that the pen is ready for printing.

DETAILED DESCRIPTION

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. The particular example set out below is the preferred specific implementation of print mechanism having a pressure regulation system and a mechanism to purge air. The invention, however, may also be applied to other types of systems as well.

I. Introduction to the Principle Parts.

Figure 1:
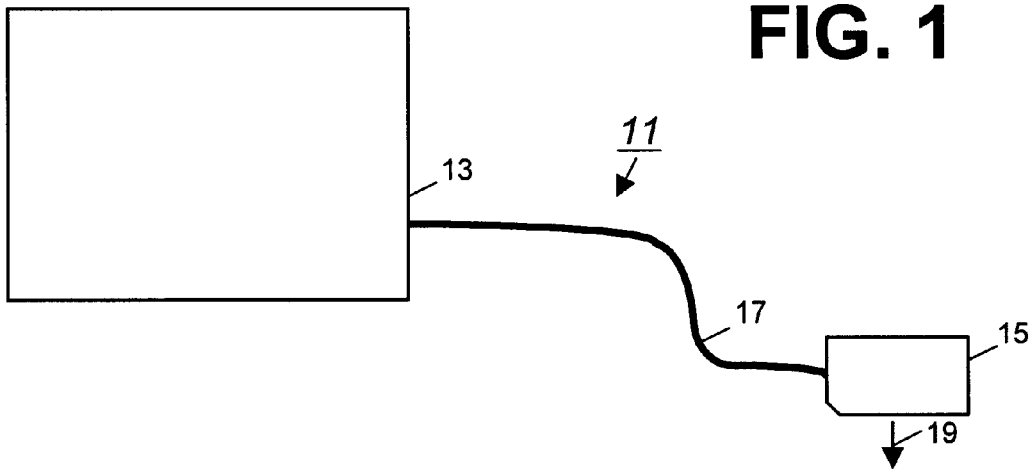
FIGS. 1–3 are used to explain the preferred use of the valve discussed herein.

As seen in FIG. 1, a preferred ink delivery system 11 includes a remote reservoir 13, a pen 15, and a supply line 17 which carries ink from the reservoir to the pen. A print head (mounted to the bottom of the pen) ejects ink as indicated by a directional arrow 19. Importantly, this preferred delivery mechanism provides a supply intended for a full range of printers, from desktop printers used at home or work to larger printers used by businesses, e.g., drum-based and poster-size printers. That is to say, with a convenient, low-cost means for reliably and actively regulating pen back pressure in a print head, it should be possible to use off-axis printing in home printer applications, in addition to business printing applications.

The pen preferably includes a pressure regulator including four primary elements: (1) an electrically controlled valve, preferably an electromagnetic valve; (2) a pressure sensor; (3) an electrically controlled feedback loop which uses the signal of the pressure sensor to control the valve; and (4) a compliant element that maintains the pressure within the pen during the response time of the valve. This pressure regulator is used to control the back pressure of the ink near the nozzles of an ink jet pen.

Figure 2:
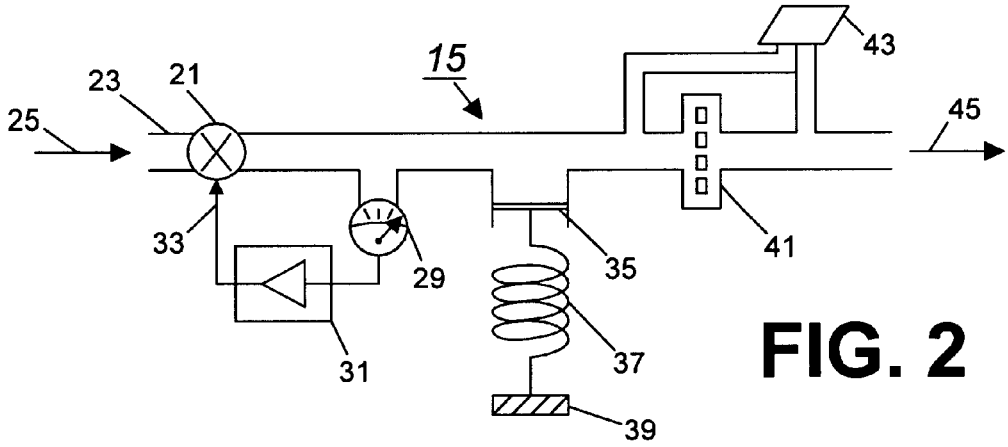

These four elements are shown schematically in FIG. 2, which shows preferred usage of an electromagnetic valve 21 in actively controlling ink within the pen 15. In particular, ink from a pressurized supply enters an ink flow path 23, as indicated by a directional arrow 25. The ink flows through the electromagnetic valve 21 and into a region in contact with the pressure sensor 29, which in turn provides an electric output signal to a computer-controlled (i.e., microprocessor-controlled) feedback path 31. This path is monitored by the computer (not separately illustrated in FIG. 2) to preferably keep ink pressure at the sensor 29 between 0.5 to ten inches of water below ambient atmospheric pressure, and the computer controls the voltage and current of the electromagnetic valve 21 as represented by signal 33 to cause the valve to open and close as necessary. Preferably, the electromagnetic valve 21 is polarized, and is configured to be normally closed unless a driving signal is applied to deliberately open or close the valve.

Ink from the valve 21 also flows into contact with a compliant element 35, which is schematically represented using a spring 37 and relative housing 39. Also shown in FIG. 2 are a filter 41, which may be necessary in some embodiments to protect the print head from stray particles, and a blow-off vent 43, which allows air to be purged from the regulator. Finally, ink exits the flow path as indicated schematically by an arrow 45, by provision of the ink to the print head (not shown in FIG. 2).

Figure 3:
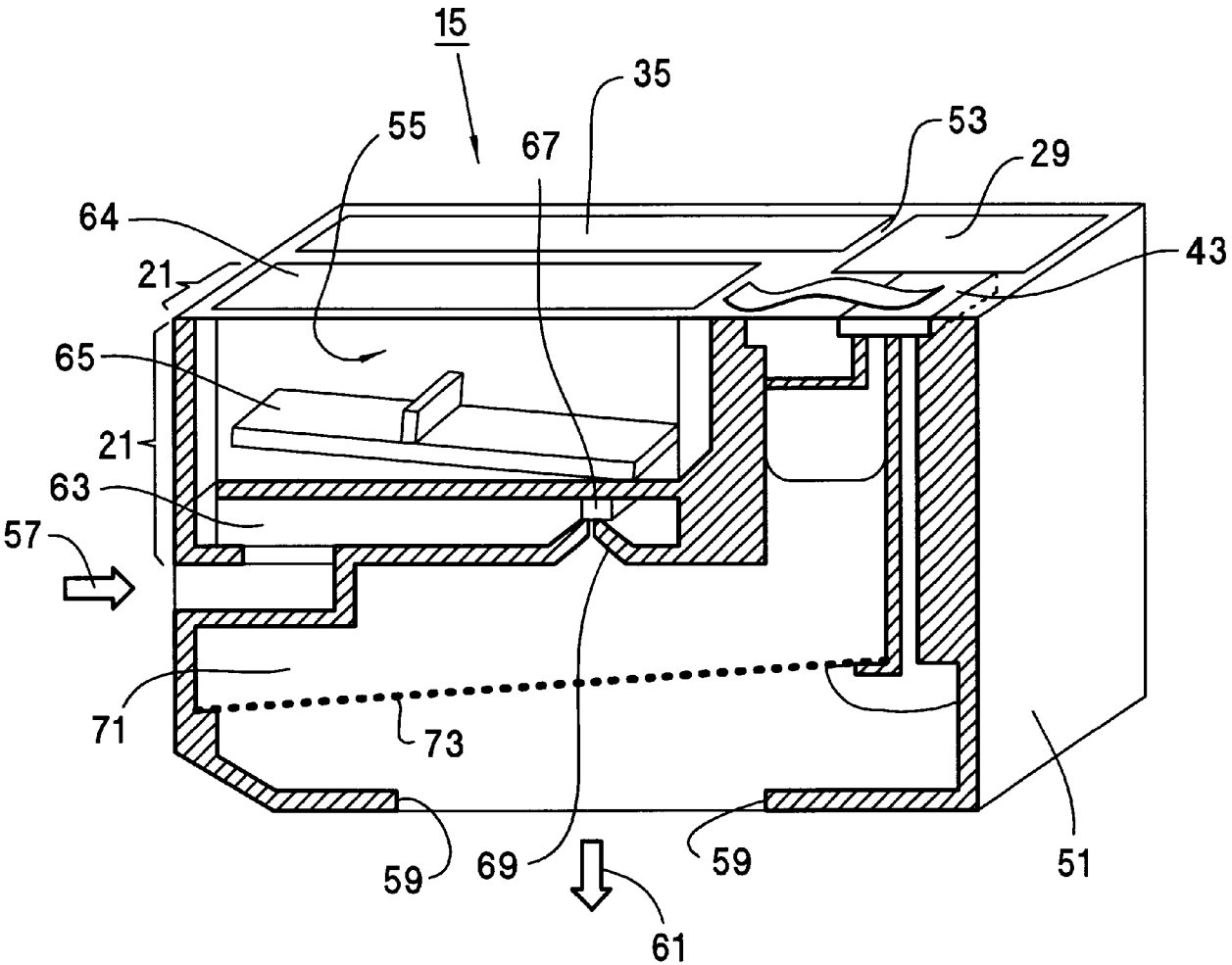

The mechanical layout of a pen implementing a valve of the present invention is illustrated in additional detail in FIG. 3. In particular, the body of the pen 15 is seen to be of roughly rectangular geometry and to include a rigid exterior housing 51. FIG. 3 illustrates a perspective view which reveals components located at a top side 53 of the pen, and interior components visible through a front lateral side 55 of the pen. Ink enters the pen 15 as indicated by an ingress arrow 57 from the remote reservoir (not seen in FIG. 3). As needed, ink is also dispensed through the print head (also not seen in FIG. 3) through a bottom port 59 of the pen, as indicated by an egress arrow 61.

Upon entering the pen, ink from the remote reservoir is delivered into fluid chamber 63 of the electromagnetic valve 21. Preferably, the valve is driven by an electric relay 64 which is based on a permanent magnet actuator, such as set forth in U.S. Pat. Nos. 5,673,012, 5,617,066, 5,337,029 and 5,162,764. Generally, these relays use both an electromagnet and a permanent magnet that cause a "see-saw" type armature to pivot in either of two pivotal directions. As seen in FIG. 3, for example, the armature 65 is pivoted clockwise in a manner that it pushes a valve head 67 closed against a valve seat 69, to prevent ink from flowing. The computer-controlled feedback path can, however, selectively open the valve, to allow ink to re-pressurize the pen. When this happens, ink flows though the valve into a pen local reservoir 71 which makes up the majority of the pen's remaining interior. Ink from the remote reservoir will normally either be pressurized or supplied via a gravity feed, such that all that is necessary to replenish ink is to pivot the armature 65 to remove the valve head 67 from the valve seat, thereby permitting fluid to flow through the valve seat and into the pen local reservoir. Once admitted to the pen local reservoir, the ink passes through a ten micron nylon mesh filter 73 to remove stray particles and settles adjacent the bottom port, ready for use by the print head.

During printing, the print head (not seen in FIG. 3) fires ink droplets under computer-control as would be conventional. As ink is removed from the pen local reservoir 71, however, sensed pressure drops. The computer (e.g., the print control microprocessor, not seen in FIG. 3) monitors this pressure and responsively opens the valve 21 to admit more ink to avoid excessive pressure drop (e.g., beyond ten inches of water below ambient atmosphere). The use of a polarized, magnetic actuator such as relay 64 permits valve response time on the order of milliseconds, with a strong throw, making it well-suited for keeping pressure tightly regulated in the ink flow path.

As seen in FIG. 3, the top side 53 of the pen 15 also reveals two other components that are in direct contact with the ink, including the pressure sensor 29, the compliant element 35, and the blow-off vent 43.

The preferred method of measuring ink pressure is to use a commercial pressure sensor to directly measure pressure, for example, using sensors such as those fabricated by Lucas Novasensor, Exar, or Motorola; the "NPH" series of pressure sensors available from Lucas Novasensor, in particular, has demonstrated good preliminary results. These commercial pressure sensors tend to provide high sensitivity and relatively fast response time. Direct pressure measurement is not the only contemplated means of measuring pressure, however, and other, alternative examples of suitable pressure sensors include a capacitive pressure sensor or a capillary network formed of foam or glass beads. Examples of the former are given by U.S. Pat. No. 6,062,681 for "Bubble Valve and Bubble Valve-Based Pressure Regulator, filed on Jul. 14, 1998, and U.S. Pat. No. 5,969,736 for "Passive Pressure Regulator for Setting the Pressure of a Liquid to a Predetermined Pressure Differential Below a Reference Pressure," filed on Jul. 14, 1998, both assigned to the same assignee as this disclosure. An example of the latter, capillary network sensor, is given by U.S. patent application Ser. No. 09/221,636 now U.S. Pat. No. 6,212, 356 for "High Output Capacitive Gas/Liquid Detector," also assigned to the same assignee as the present invention.

The compliant element 35 is utilized because ink and similar fluids are substantially incompressible. When the valve is closed and ink is fired from the print head, the volume of ink within the pen decreases. The compliant element helps ensure that small changes in the volume of ink do not cause a large change in pressure which affects the firing of ink from the print head. The required compliance depends on the response time of the valve and the desired regulation range. In the preferred embodiment, the response time of the valve is on the order of milliseconds, the flow rates are approximately ten milliliters per minute, and the desired regulation range is a few tenths of an inch of water. Given these values, one skilled in the art may readily select an appropriate compliant element.

In one embodiment, for example, the compliant element 35 may be a deliberately designed air bubble within the pen body. For example, a one cubic centimeter air bubble should provide sufficient compliance for the pressure to be maintained adequately. Other embodiments may include a spring attached to a flexible boundary between the ink and atmosphere (e.g., via use of spring bag), a rubber membrane, a capillary network, or a movable boundary between the ink reservoir and a reservoir of fluid held at a different pressure.

The computer-controlled feedback path is preferably used for more than just maintaining ink pressure at a particular value. For example, a computer may use sensed pressure characteristics (including air presence) and print head efficiency information to change the back pressure of the ink. The ink back pressure which yields the highest print quality varies from print head to print head and is dependent on the ink characteristics, ink flow rate, and paper type. Electrical control of the back pressure permits each pen to be fine-tuned to increase print quality and printer though put.

To perform this task, each pen is preferably measured for optimal print performance either during production or electronically by the printer during pen life, to calculate a specific back pressure; this pressure is then stored in the computer (print control microprocessor) memory and is used in connection with the pressure sensor 29 to precisely control pen back pressure in each pen. Electrical control of the feedback path allows the pen to be occasionally disabled for additional functionality, such as, calibration of the pressure sensor, priming of the print head, detection of air and, as will be discussed below, purging of air from the system.

II. The Preferred Valve.

Importantly, it is expected that a valve made according to this disclosure can be both quite small and made at a fraction of the cost of many currently-available magnetic actuators; for example, it is anticipated that the valve indicated in FIG. 3 can be produced for less than two U.S. dollars, and to have dimensions such that an entire pen has a height of two centimeters or less. The preferred valve is also designed to be compatible with a variety of fluids including both dye-based and pigment based inks. The ability to produce such a high-performance low-cost valve should render it quite feasible to incorporate small, high-performance valves in many consumer applications, not just in printers.

FIG. 4 presents a perspective view of the preferred valve 139, showing a fluid outlet 143 and inlet 145 which are visible from the exterior of the valve, and four layers which make up the body of the preferred valve. These layers include a top, molded cover 141, which preferably is molded to include all fluid ports, and the valve seat. At the base of the complete valve 139 is a bottom, relay-housing layer 147, which is made to snugly fit the relay and permit relay connection terminals to protrude through the bottom of the valve for electrical connection; these terminals also provide vent holes so as to keep the pressure at the relay roughly atmospheric. In between these two layers are a compliant diaphragm 149 and a relay template layer 151. The compliant diaphragm is preferably made of a thin material which resists fatigue and acts as a diffusion barrier to water and air. A suitable material is "Saranex" (available from Dow-Corning); elastomeric materials such as butyl rubber, "EPDM," silicone rubber or a fluoro-elastomer may also be suitable for some applications. Together, these four layers can be either heat staked together, tightened together by means of a number of nuts and bolts, glued with epoxy, or connected by other means. Importantly, the compliant diaphragm acts as a soft sealing material, such that when the layers are properly tightened together, the compliant diaphragm provides a complete fluidic seal that prevents any external leakage of fluid from the valve. The template layer, by contrast, supports the compliant diaphragm to properly balance the forces applied to the relay by the compliant diaphragm.

The top, molded cover 141 is constructed of a rigid plastic material such as polyethylene, "polysulfone," "Delrin," or other suitable materials; it is roughly rectangular in configuration, excepting passages for fluid ports. Walls 159 of the cover are molded to help define part of the fluid chamber, which is completed when the molded cover is attached against the compliant membrane and the relay template. The fluid ports include an outlet 143 and an inlet 145, and are oriented as indicated by center lines 144 and 146. A bottom most portion of the outlet defines the valve seat 153, which as mentioned, has a curved rim 155 to help provide a good seal against the compliant diaphragm 149.

The compliant diaphragm is also molded, preferably to have two flexible sealing surfaces, each with a raised annular fold 163 and a raised nipple 165. Seen directly underneath of the valve seat 153 (and aligned with the outlet's center axis 144), the nipple is displaced upward to contact and seal the valve seat, preventing the escape of fluid. The annular fold reduces the force required to displace the nipple.

Two identical sealing surfaces are provided as part of the compliant diaphragm, each sealing surface symmetrical about the center of the compliant diaphragm. This design is consistent with the principle, mentioned above, that each end of the relay armature is made such that relatively constant volume is maintained in the valve during operation, e.g., such that fluid pressure does not act against the closing of the valve during upward displacement of the compliant diaphragm against the valve seat 153.

Positioned directly beneath the compliant diaphragm is the relay template 151, which can be made of either a metal or plastic material, and which helps prevents excursion of the compliant diaphragm toward the relay. The template provides two circular openings 182, which permit the relay to contact and displace either nipple of the compliant diaphragm.

Finally, the bottom, relay-mounting layer 147 is composed of the same material as the top layer, and it also has walls 161 which define a receptacle for an electric relay 171. This receptacle is preferably sized just large enough to snugly accommodate the relay. As seen in FIG. 4, the relay includes a main body having an internal electromagnet 173, a number of electrical terminals 175, and a pivoting armature 177. The electrical terminals permit selective driving of the relay such that it pivots in either pivotal direction, e.g., such that the valve can be driven open or closed as desired using the electromagnet positioned within the main body. The relay is also a polarized, magnetic actuator, such that it also has a permanent magnet 185, which helps generate sufficient force to open and close the valve using a small actuator.

Once all parts are aligned in the manner indicated by FIG. 4, then the relay can be directly attached to the top, molded cover layer. Very few modifications are necessary in the procurement and use of the relay. An epoxy or pressure sensitive tape should be attached to either side of the armature to attach the armature to the compliant membrane. The standard relay cover should not be attached to the relay. Some of the electrical leads may be removed, as appropriate.

With the layers aligned, they can be mounted together using a heat staking process, nuts and bolts, a suitable epoxy, and any combination of the foregoing or with another conventional attachment process.

Importantly, the force applied between the valve seat and the valve face must be large enough to ensure that the valve is leak proof. The force that the relay applies to the valve seat will depend on the pre-load amount. For a pre-load of approximately one hundred microns, the force applied by the relay is approximately four grams which should be sufficient to provide a leak proof seal of silicon rubber against the valve face.

The preferred valve is additionally described by U.S. Patent Application for a "Magnetically-Actuated Fluid Control Valve," filed on the same date as the present disclosure on behalf of inventors Storrs T. Hoen, Naoto Kawamura and Jonah A. Harley and assigned to the same assignee as the present invention; this copending Patent Application is incorporated herein by reference, as though identically reproduced herein.

III. Use of the Preferred Pen and Pressure Regulation System to Purge Air.

A. Monitoring of Air within the Pen.

The pressure regulation system discussed above is used in the preferred embodiment to purge unwanted air from an ink pen.

In normal operation, the computer (i.e., print control microprocessor) periodically samples the aforementioned pressure sensor to determine instantaneous pressure. As previously mentioned, each pen can be individually tested to determine optimal back pressure unique to that pen, and the result programmed into a chip located within each pen. Alternatively, the print control microprocessor can simply regulate back pressure to a specific value or a range within between one-half and ten inches of water below ambient atmosphere.

In additional to simply measuring pressure, computer firmware preferably analyzes several pressure readings at several millisecond intervals following opening the valve to determine transient pressure response. Basically stated, all compliant elements in the pen have a recovery time; unwanted air in the pen causes the pressure inside the pen to rise at a slower rate and it is this slower rate that the firmware attempts to detect and measure. Measuring the transient response provides the firmware with an estimate for the quantity of air trapped in the pen as well as with an estimate for the amount of additional ink which needs to be added to purge this air.

To accomplish these ends, testing is performed in advance for a given pen model to determine variance in pressure transient response as a function of air within the pen; the results of this testing are programmed into the computer firmware for later use in periodically purging air. For example, FIG. 5 presents a graph 199 of air quantity versus pressure transient response following opening the valve, and such information would be incorporated directly into the computer. Armed with this information during normal operation, the computer samples pen pressure fairly rapidly, e.g., every few milliseconds, to enable a computation of both instantaneous pressure and pressure response time. The response time is compared to a table of stored information, such as presented by FIG. 5, and used by the computer firmware to calculate an estimate of air within the pen.

In the preferred embodiment, the estimate of air in the pen is then compared with a pre-defined threshold, representing maximum air within the pen. If the threshold is exceeded, then the computer determines that the pen needs to have some air purged. In an alternative embodiment, the computer firmware maintains a pre-defined amount of air within the pen, such as where an air bubble is deliberately maintained within the pen as a compliant element. In this alternative embodiment, the computer can cause the pen to intake additional air through the blow-off vent, in a manner that will be explained below.

B. Adjusting Air within the Pen.

Figure 6:
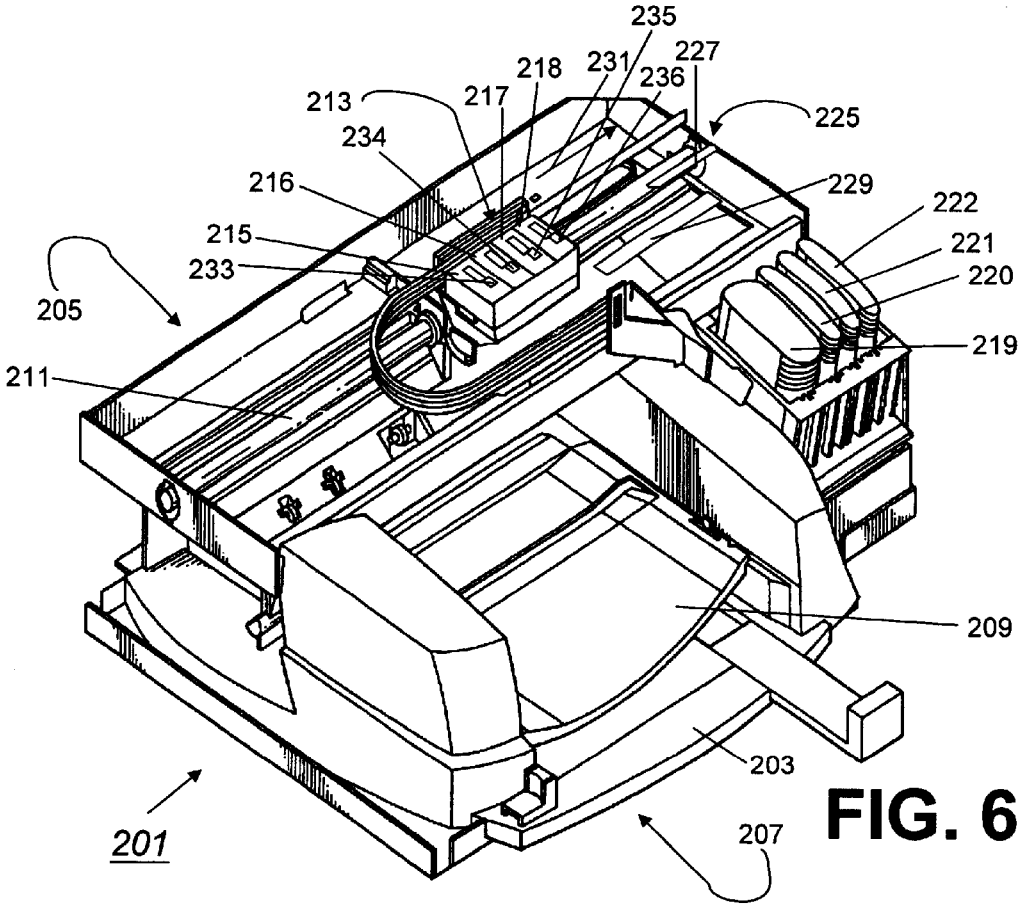
FIG. 6 is a perspective view of an off-axis printer having four pens (one black and three color) which travel along a carriage; each pen is seen to have a leaf spring on the top of the pen which is mechanically lifted to open the corresponding blow-off vent.

FIG. 6 presents a perspective view used to illustrate operation of a printer 201 when it is determined that an improper amount of air is in a pen. FIG. 6 shows the printer without any top cover, for the purposes of illustrating the printer's interior components.

Paper enters the printer from a paper tray 203 and is conveyed along a paper conveyance path that takes the paper to a rear end 205 of the printer. At this location, the paper conveyance path makes an upward U-turn, and the paper is directed back toward a front end 207 of the printer, specifically to an output tray 209. Just after the upward U-turn, the paper passes beneath the transverse guide 211 which mounts the print carriage 213. The print carriage is seen in FIG. 6 to mount four ink pens 215–218 (one black and three colored), each one having a hose that connects it to a corresponding remote ink supply 219–222 near the front end of the printer. The print carriage moves transversely along the guide 211, back and forth over the paper conveyance path, as the paper moves beneath it and toward the output tray.

Within its interior, the printer 201 also has a print carriage service station, generally at the location designated 225 in FIG. 6. While a typical service station performs many tasks, the service station in FIG. 6 is illustrated for ease of explaining the preferred embodiment to have two elements; these two elements include a projecting tab 227 and a drool receptacle 229.

Since print heads have conventionally been known to drool when pen pressure is too high, air is preferably purged only when the pens 215–218 are secure at the service station, at the far right 225 of the printer. In this location, the print heads are positioned directly above the drool receptacle 229 which includes means for ensuring that ejected ink is collected and that the print heads are clean when the pens are again moved above the paper conveyance path for printing.

Thus, as indicated by a transverse arrow 231, when it is determined that air needs to be vented with respect to one or more pens 215–218, the print carriage 213 is moved toward the service station and the location 225. As the print carriage nears the extreme right of the print station, the projecting tab 227 is slid under each of four leaf springs 233–236, one on top of each of the four pens. This action serves to lift all four leaf springs upward, to thereby open the blow-off vent in each pen, to permit the purging of air. Simultaneously, the computer can open the internal valves in each pen to selectively pressurize each pen with ink, or fire print heads as appropriate. Preferably, the service station includes several laterally-adjacent positions for the print carriage 213, with only the extreme right position causing the blow-off vents to be opened. In this manner, the pens may be fired while in the print station but with the blow-off vents closed to lower internal pressure and to ready the pens for renewed printing.

Figure 7:
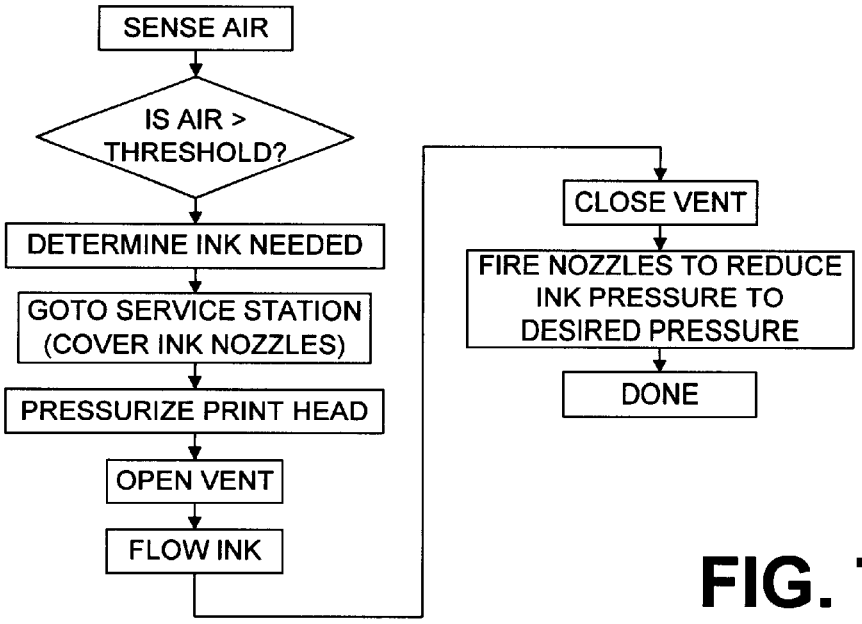
FIG. 7 is a block diagram which shows steps in the sensing and purging of air in the preferred embodiment.

These operations are further illustrated by FIG. 7, which provides a block diagram indicating steps in purging air in the preferred embodiment, and by FIGS. 8–11, which illustrate pen movement in performing these tasks.

Figure 8:
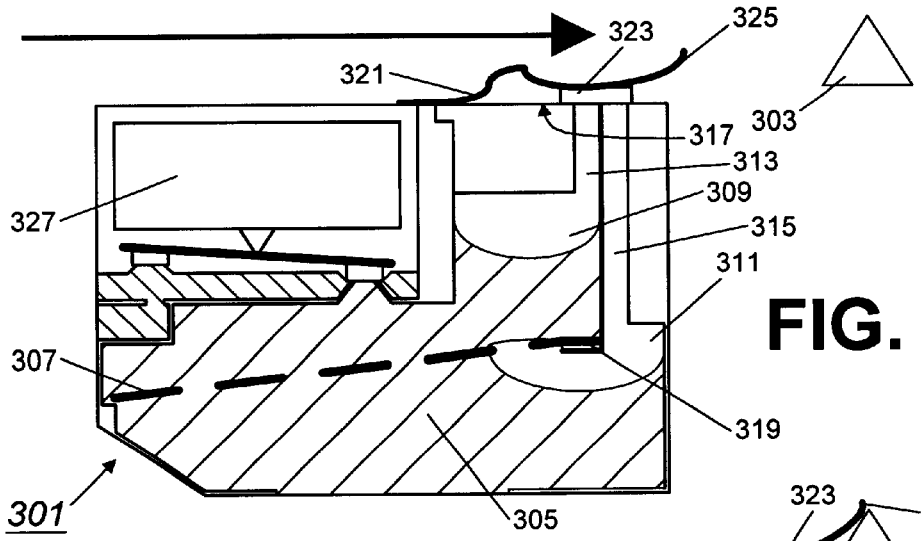
FIGS. 8–11 are cross-sectional diagrams of a pen used to illustrate the preferred mechanism and method for venting air.

More particularly, FIG. 8 shows a cross-section of a single pen 301 as it is being converged with the projecting tab 303. In FIG. 8, this motion is shown as being parallel to the pen, that is, in a different sense than was illustrated by the arrow 231 of FIG. 6. This different motion may be preferred depending upon the configuration of print station. For example, some print stations feature rotating turntables for performing different services upon a pen; in this regard, the motion indicated in FIG. 8 may be part of a service station turntable, where the pen is kept stationary, but the tab is moved into contact with the pen when it is desired to vent air.

The interior of the pen 301 reveals a supply of ink 305 and a ten micron nylon mesh filter 307, as was mentioned earlier. In this example, it is to be assumed that two air pockets 309 and 311 have formed, and that it is desired to remove some or all of this air. Notably, two air escape paths or conduits 313 and 315 are preferably designed into the pen, such that as air is released from the ink, it gravitates upward and is channeled into one of these two conduits. One conduit 313 catches air at a top end 317 of the pen, whereas another conduit begins at a top end 319 of the nylon mesh 307, which is tilted to urge air toward the conduit. Two conduits are used because the nylon mesh acts as a barrier to air, and air can be generated at the print head as well as in the body of the pen.

On the top of the pen, a leaf spring 321 resiliently urges a silicone cover 323 to close the blow-off vent; since pen pressure is normally maintained at a pressure which is less than ambient atmosphere, the leaf spring will be effective to seal the cover against the blow-off vent, to thereby normally prevent the flow of air between the pen and the ambient atmosphere. The leaf spring includes an upwardly flared free end 325, which is adapted to engage the protruding tab 303 and be lifted thereby to open the vent.

Figure 9:
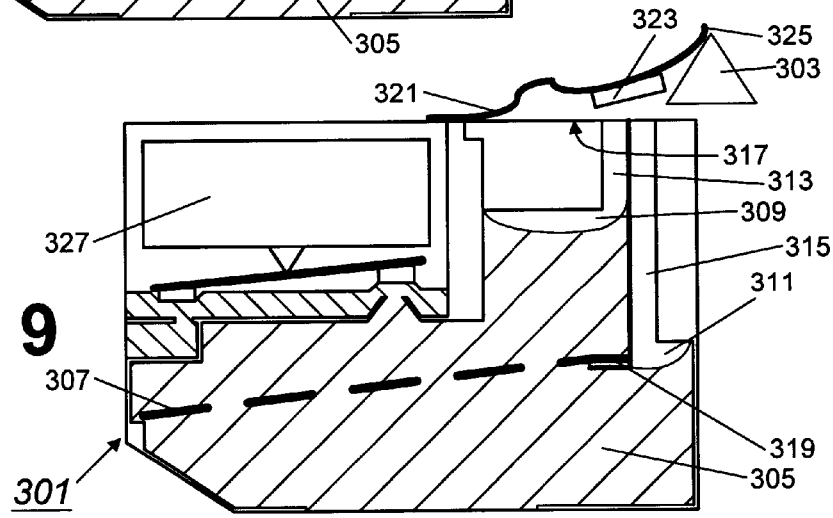

Preferably, the printer's computer will calculate precisely the amount of air that must be purged from each pen, and will responsively open the internal valve 327 of each pen in order to pressurize the ink within the pen to a calculated pressure. Consequently, as indicated in FIG. 9, as the blow-off vent is opened, air is forced out such that the air pockets 309 and 311 are reduced to a manageable level.

Figure 10:
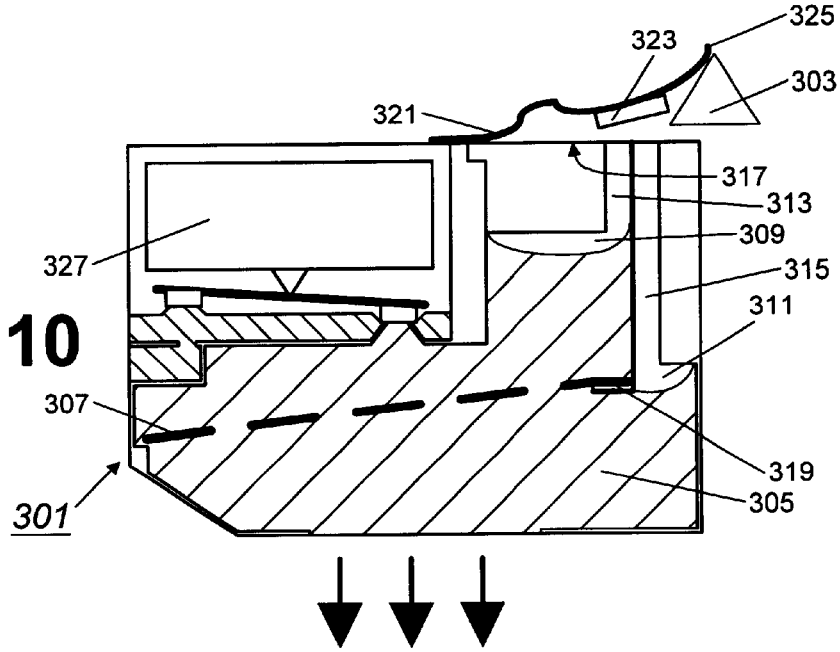

As mentioned earlier, in some embodiments where air is deliberately used as a compliant element, it may be desired to precisely control air within the pen, including by increasing the amount of air within the pen. FIG. 10 is used to indicate how this may be accomplished, namely, by closing the internal valve 327 and by firing ink from the pen with the blow-off vent open, to thereby cause ambient air to enter the pen. In the preferred pen indicated earlier in FIG. 3, however, a rubber membrane (and not air) is preferably used as the compliant element; in this case, it is desired to purge as much air as possible from the pen and, therefore, ambient air preferably is never drawn into the pen in this case.

Figure 11:
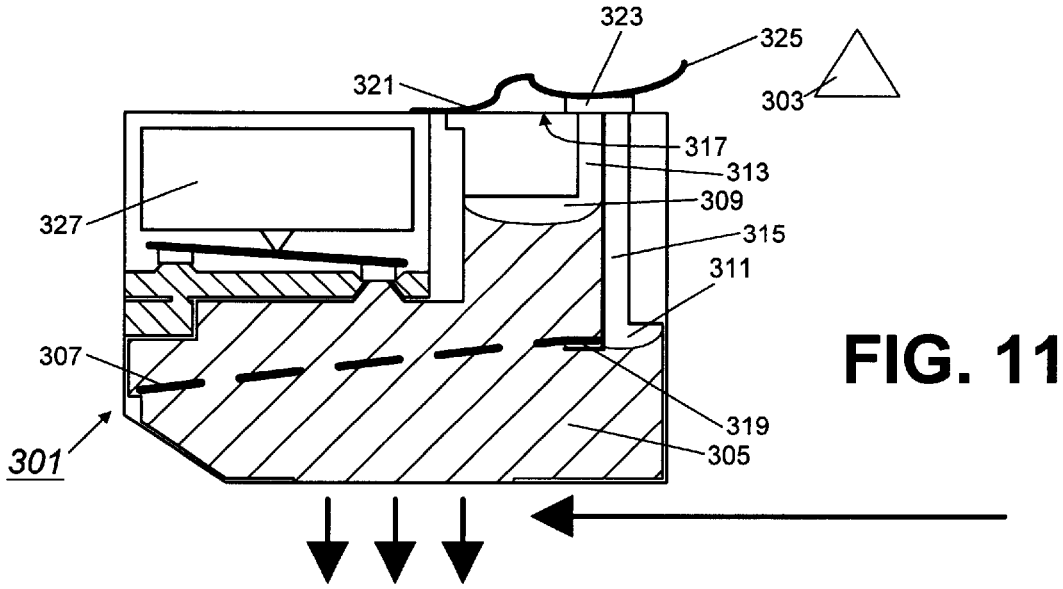

Finally, as indicated in FIG. 11, once air within the pen 301 has been adjusted as desired, the pen preferably is fired a controlled amount with the blow-off vent closed in order to lower the internal pressure of the pen to between one-half and ten inches of water below ambient atmosphere. This firing preferably occurs over the drool receptacles, mentioned earlier. Once this task is accomplished, the pen is ready for other servicing or to return to print duty.

Importantly, those skilled in electronics or valve design will recognize that modifications may readily be performed to the embodiment stated above without departing from the principles of the present invention. For example, while the use of the particular venting mechanism illustrated offers certain advantages in terms of valve operation, it may be possible to use other configurations to vent air. It may be possible to use an electrically-controlled vent, or to mechanically open a blow-off vent using a different structure. These modifications are all within the scope of the present invention.

Having thus described several exemplary implementations of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. In an off-axis printer including a local ink container supplying a print head and a remote ink supply which provides ink to the container, an improvement comprising:

using a transducer to generate an electric signal;

monitoring the electric signal over time and deriving therefrom quantity of air within the print ink container;

opening a blow-off vent; and pressurizing ink within the local ink container, to thereby expel air from the local ink container.

2. An improvement according to claim 1, wherein the local ink container includes a filter, further comprising:

two air escape paths which couple the blow-off vent with the local ink container, including a first air escape path on a first side of the filter, and a second air escape path on a second side of the filter, each air escape path configured to collect air bubbles gravitating upward within ink and to expel the air bubbles upon pressurization of the local ink container while the blow-off vent is open.

3. An improvement according to claim 1, further comprising:

an actively driven ink supply system; and opening a valve to permit flow of ink from the actively driven ink supply system into the local ink container to thereby pressurize the local ink container.

4. An improvement according to claim 1, further comprising:

selectively firing the print head to thereby reduce pressure within the local ink container.

5. An improvement according to claim 4, further comprising:

optimizing air within the local ink container by selectively opening the blow-off vent, selectively firing the print head and selectively pressurizing the local ink container, to generate a controlled-amount of air within the local ink container.

6. An improvement according to claim 4, further comprising:

selectively firing the print head with the blow-off vent closed to thereby reduce pressure within the local ink container to below ambient atmospheric pressure.

7. An improvement according to claim 1, wherein the transducer is a pressure sensor.

8. An improvement according to claim 1, further comprising:

comparing the quantity of air to a threshold; and responsive to the comparison, simultaneously opening the blow-off vent and pressurizing the ink to force excess air out of the local ink container.

9. An improvement according to claim 1, further comprising:

using the transducer to measure pressure response following change in ink volume; and calculating the quantitiy of air based on comparison of pressure response with precomputed data.

* * * * *